US007891074B2

(12) United States Patent
Kodi

(10) Patent No.: US 7,891,074 B2
(45) Date of Patent: Feb. 22, 2011

(54) BAR CONNECTING APPARATUS

(75) Inventor: Jon R. Kodi, Lebanon, TN (US)

(73) Assignee: Kodi Klip Corporation, Lebanon, TN (US)

( * ) Notice: Subject to any disclaimer, the term of this patent is extended or adjusted under 35 U.S.C. 154(b) by 941 days.

(21) Appl. No.: 11/622,674

(22) Filed: Jan. 12, 2007

(65) Prior Publication Data

US 2008/0115448 A1 May 22, 2008

Related U.S. Application Data

(60) Provisional application No. 60/860,434, filed on Nov. 21, 2006.

(51) Int. Cl.
*B23P 11/00* (2006.01)

(52) U.S. Cl. ..... 29/525.01; 29/243.56

(58) Field of Classification Search ..... 29/525.01, 29/525.08, 809, 811.2, 243.56
See application file for complete search history.

(56) References Cited

U.S. PATENT DOCUMENTS

| | | | | | |
|---|---|---|---|---|---|
| 721,434 | A | * | 2/1903 | Edeburn | 29/243.56 |
| 1,451,717 | A | * | 4/1923 | Sommer | 29/755 |
| 1,852,673 | A | | 4/1932 | Pilj | |
| 1,986,528 | A | | 1/1935 | Ranger | 72/122 |
| 2,455,557 | A | * | 12/1948 | Burner | 29/816 |
| 2,551,826 | A | | 5/1951 | Cox, Sr. | 72/122 |
| 2,571,337 | A | | 10/1951 | Burnham | 61/48 |
| 2,583,056 | A | * | 1/1952 | Lang | 29/243.56 |
| 2,879,087 | A | | 3/1959 | Haglund | 287/54 |
| 3,006,115 | A | | 10/1961 | Hillberg | 50/322 |
| 3,216,752 | A | | 11/1965 | Rifken | 287/54 |
| 3,360,883 | A | | 1/1968 | Glanzer | 46/29 |
| 3,461,536 | A | * | 8/1969 | Skold | 29/811.2 |
| 3,694,988 | A | | 10/1972 | Skold | |
| 3,788,025 | A | | 1/1974 | Holmes | 52/685 |
| 4,060,954 | A | | 12/1977 | Liuzza | 52/677 |
| 4,080,770 | A | | 3/1978 | Vigh | 52/689 |
| 4,110,951 | A | * | 9/1978 | Padrun | 52/686 |
| 4,136,984 | A | | 1/1979 | Hayashi | 403/170 |
| 4,136,985 | A | | 1/1979 | Taul | 403/172 |
| 4,214,841 | A | | 7/1980 | Hayashi | 403/188 |

(Continued)

FOREIGN PATENT DOCUMENTS

JP 04108944 4/1992

OTHER PUBLICATIONS

U.S. Appl. No. 11/333,756, filed Jan. 17, 2006 by Jon Kodi.

(Continued)

*Primary Examiner*—David P Bryant
*Assistant Examiner*—Jacob J Cigna
(74) *Attorney, Agent, or Firm*—Waddey & Patterson, P.C.; Lucian Wayne Beavers

(57) ABSTRACT

A bar connecting apparatus applies clips to connect transverse bars used in reinforced concrete. A clip string is fed into the bar connecting apparatus by a clip feed assembly, so several pairs of transverse bars can be connected in rapid succession. A hammer reciprocates in the barrel of the bar connecting apparatus, and drives a clip from the barrel into engagement with the bars. An alignment head aligns the bar connecting apparatus with the transverse bars so the clips properly engage the bars.

13 Claims, 8 Drawing Sheets

U.S. PATENT DOCUMENTS

| | | | | | |
|---|---|---|---|---|---|
| 4,388,791 | A | * | 6/1983 | Anderson | 52/719 |
| 4,440,519 | A | | 4/1984 | Pennel et al. | 403/391 |
| 4,482,088 | A | | 11/1984 | Hyun | 227/67 |
| 4,511,073 | A | | 4/1985 | Furutsu | 227/67 |
| 4,610,122 | A | | 9/1986 | De Clercq | 52/719 |
| 4,617,775 | A | | 10/1986 | Padrun | 52/684 |
| 4,791,707 | A | * | 12/1988 | Tucker | 227/19 |
| 4,800,702 | A | | 1/1989 | Wheeler | 52/677 |
| 4,807,345 | A | * | 2/1989 | Jacobson | 29/243.56 |
| 4,835,933 | A | | 6/1989 | Yung | 52/685 |
| 4,991,372 | A | | 2/1991 | Sonneville | 52/685 |
| 5,269,054 | A | | 12/1993 | Poteat et al. | |
| 5,370,293 | A | | 12/1994 | Bevins | 227/63 |
| 5,371,991 | A | | 12/1994 | Bechtel et al. | 52/686 |
| D355,582 | S | | 2/1995 | Sleight | D8/354 |
| 5,518,399 | A | | 5/1996 | Sicurelli, Jr. et al. | 433/220 |
| 5,588,554 | A | | 12/1996 | Jones | 221/88 |
| 5,595,039 | A | | 1/1997 | Lowery | 52/677 |
| 5,626,436 | A | * | 5/1997 | Dragone | 403/400 |
| 5,683,025 | A | | 11/1997 | Grendol | 227/67 |
| 5,697,591 | A | | 12/1997 | Cooper | 248/229.16 |
| 5,752,297 | A | | 5/1998 | Ramey | 24/462 |
| 5,826,629 | A | * | 10/1998 | West | 140/119 |
| 5,881,452 | A | * | 3/1999 | Nowell et al. | 29/816 |
| 5,893,252 | A | | 4/1999 | Hardy, Jr. et al. | 52/685 |
| 5,938,099 | A | * | 8/1999 | Ciccarelli | 227/19 |
| 6,148,488 | A | | 11/2000 | Gristock | 24/462 |
| 6,276,108 | B1 | | 8/2001 | Padrun | 52/684 |
| 6,354,054 | B1 | | 3/2002 | Verelli et al. | 52/686 |
| 6,371,763 | B1 | | 4/2002 | Sicurelli, Jr. et al. | 433/220 |
| 6,513,555 | B1 | | 2/2003 | Lesser et al. | 140/123.6 |
| 6,585,142 | B1 | | 7/2003 | Chen | 227/130 |
| 6,640,406 | B2 | * | 11/2003 | Wilson | 29/243.56 |
| 6,672,498 | B2 | | 1/2004 | White et al. | 227/120 |
| 6,725,535 | B2 | * | 4/2004 | Edson et al. | 29/809 |
| 6,857,246 | B2 | | 2/2005 | Erbetta et al. | 52/653.2 |
| 6,915,624 | B2 | | 7/2005 | Shibazaki et al. | 53/588 |
| 6,925,698 | B2 | | 8/2005 | Goodsmith et al. | 29/432.1 |
| 6,971,515 | B2 | | 12/2005 | Cooper et al. | 206/343 |
| 7,003,860 | B2 | | 2/2006 | Bloch et al. | 29/407.1 |
| D529,794 | S | | 10/2006 | Murray | D8/396 |
| 7,147,209 | B2 | | 12/2006 | Jones et al. | 254/25 |
| D534,418 | S | | 1/2007 | Minor et al. | D8/396 |
| 2003/0154579 | A1 | | 8/2003 | Disher | 24/462 |
| 2004/0040247 | A1 | | 3/2004 | Morse | 52/649.8 |
| 2004/0154261 | A1 | | 8/2004 | Miller | 52/719 |
| 2004/0261352 | A1 | | 12/2004 | Bennett et al. | 52/698 |
| 2005/0217198 | A1 | | 10/2005 | Carraher et al. | 52/719 |
| 2006/0248844 | A1 | | 11/2006 | Kodi | 52/712 |
| 2007/0284385 | A1 | * | 12/2007 | Carraher et al. | 221/27 |
| 2008/0118304 | A1 | * | 5/2008 | Carraher et al. | 403/396 |

OTHER PUBLICATIONS

U.S. Appl. No. 11/142,539, filed Jun. 1, 2005 by Jon Kodi.
Exhibit A: Jiffy Clip Long Gun Applicator by Jiffy Clip, Inc. (see www.jiffyclip.com) (undated but admitted to be prior art).

* cited by examiner

BAR CONNECTING APPARATUS

CROSS-REFERENCES TO RELATED APPLICATIONS

This application is a Non-Provisional Utility application which claims benefit of co-pending U.S. Provisional Patent Application Ser. No. 60/860,434 filed Nov. 21, 2006, entitled "CLIP APPLYING APPARATUS" which is hereby incorporated by reference.

BACKGROUND OF THE INVENTION

1. Field of the Invention

The present invention relates to an apparatus and method for attaching clips to connect bars, wherein the bars are used to reinforce concrete. Reinforcing bars are commonly placed within a frame where cement is to be poured, so that the reinforcing bars will become encased in the poured cement. The reinforcing bars are placed in specified positions at specified heights within the frame, so the resulting concrete is strengthened. One method used to connect the reinforcing bars before the cement is poured is clips. These clips are attached at the intersection of two bars, so the bars are held together in a fixed position. The current invention provides an apparatus and a method for attaching clips to intersecting bars.

2. Description of the Related Art

Supporting bars are commonly used to reinforce concrete. The supporting bars are laid out in a grid where the cement is to be poured. To maximize the effectiveness of the supporting bars, they are placed at specified heights, usually between about 2 and 6 inches from the ground. The bars are then connected so the grid is stable and will not move when the concrete is poured.

Many methods have been used to connect the bars, and many are done by hand. Rebar is the type of supporting bar most commonly used. When the rebar is connected by hand, it requires a laborer to bend over and connect the rebar at many points within the grid. This is labor intensive, slow, and tends to cause injuries from the repeated bending. In some instances, the rebar grid can be prepared first, and then placed into a form where the concrete will be poured. This can reduce the bending required, but does not address the time and labor needed to connect the rebar. To reduce the time needed to connect rebar and to minimize the time a laborer is working in a stooped over position, several applicators for connecting the rebar have been developed.

For example, in U.S. Pat. No. 5,881,452 Nowell et al. describes an apparatus for applying deformable metal fastener clips to concrete reinforcement steel. The Nowell device is a hand held applicator. It applies generally U-shaped deformable metal clips at the intersection of pieces of reinforcing rebar or wire mesh sheets. The apparatus is used to place the U-shaped metal clip around adjacent metal bars and then deform and close the U, thus connecting the bars.

West, in U.S. Pat. No. 5,826,629, describes a pneumatic wire tying apparatus for tying crossed reinforcing bars together. This device has a guide member which opens to receive intersecting bars, and then closes onto the bars. In the closed position a length of wire is guided around the bars. A feed mechanism feeds a wire to the guide member, and a twist member engages and twists the wire around the reinforcing bars.

BRIEF SUMMARY OF THE INVENTION

The current invention relates to an apparatus for applying clips to connect reinforcing bar as is typically used in concrete structures. The bar connecting apparatus as described is designed to fasten plastic clips as defined in U.S. patent application publication number 2006-0248844 A1, which is incorporated herein by reference. The clips are inserted into a barrel, and the apparatus is positioned over transverse supporting bars. A hammer reciprocates longitudinally within the barrel and strikes the clip. The hammer propels the clip out of the distal end of the barrel, which is positioned over the transverse bars, such that the clip engages and connects the bars. An alignment head at the distal end of the barrel is utilized to position the bar connecting apparatus relative to the transverse bars.

The clips are provided in a clip string, which is a plurality of clips connected together. In one embodiment, the clips are connected directly to each other, and in another embodiment the clips are connected to a common feed rod. The clip string is inserted into a clip feed assembly, which directs a clip into a clip receiving cavity in the barrel each time the hammer reciprocates. The clip feed assembly engages the hammer through a cam guide, so the motion of the hammer as it reciprocates provides the drive to cycle the clip feed assembly. Therefore, each time the hammer propels a clip from the barrel, the clip feed assembly inserts another clip from the clip string into the barrel, so the bar connecting apparatus can connect several pairs of transverse bars in rapid succession.

The clip feed assembly utilizes at least one finger to engage and advance the clip string into the clip receiving cavity. The finger has a pivot point and a sloped side so the finger can ratchet backwards along the clip string before engaging and urging the clip string forward into the clip receiving cavity. The backwards ratcheting motion and forward engaging motion allows the finger to advance clips into the clip receiving cavity as the clip feed assembly reciprocates laterally with each cycle of the hammer.

The clip feed assembly includes a clip track, which supports the clip string outside of the clip receiving cavity. In one embodiment, the clip track engages the clip from the top, and the clip track extends through the clip receiving cavity. The hammer has an indentation with legs, so the clip track is received in the indentation with the hammer legs passing beside the clip track. The legs contact and drive the clip from the barrel. In a second embodiment, the clip track terminates before entering the clip receiving cavity, and a resilient retainer is utilized to hold the clip in place until it is driven from the bar connecting apparatus.

The hammer is reciprocated by a drive, which can be powered by many sources, including manual and pneumatic sources. The power source first biases the drive and the connected hammer distally to drive a clip from the barrel. Next, the drive and hammer are biased proximally to reposition the hammer for the next clip, and to complete the associated cycling of the clip feed assembly. A handle and a biasing spring are used for the manual embodiment, and a trigger is used to actuate a pneumatic or other power source.

DETAILED DESCRIPTION OF THE INVENTION

Clip String

Figure 1:
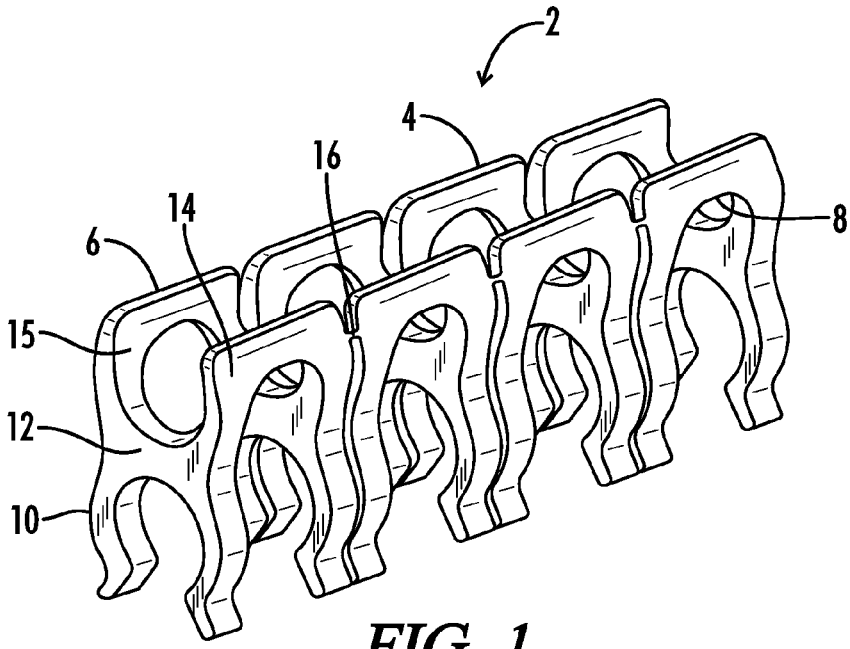
FIG. 1 is a perspective view of the clip string.
Figure 2:
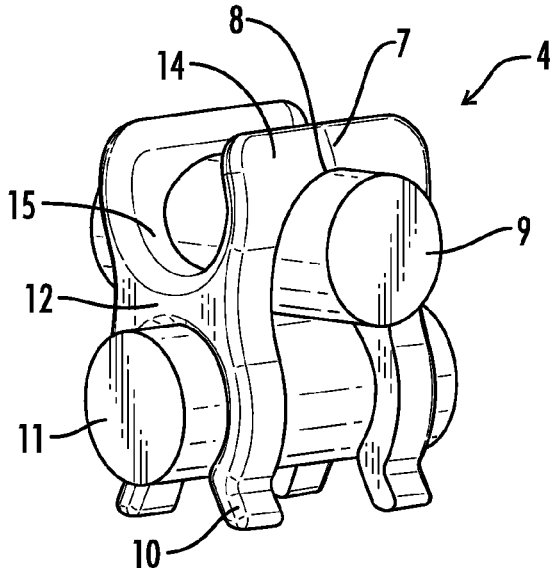
FIG. 2 is a perspective view of a single clip engaged with transverse bars.

The Bar Connecting Apparatus utilizes a clip string 02 as depicted in FIG. 1. The clip string 02 is comprised of a plurality of connected individual clips 04, wherein the last clip in the series is the terminal clip 06. In the preferred embodiment, the clips 04 are comprised of plastic and each clip 04 has several components. Referring to FIG. 2, the seat 08 is adapted to engage and position a first bar 09. Below the seat 08 are a plurality of hooks 10, preferentially four hooks 10 per clip 04, which are adapted to engage and position a second bar 11 transverse to the first bar 09. The first bar 09 is also positioned on top of the second bar 11. The hooks 10 are joined by a joining portion 12, and each hook 10 has an upper body 14.

The upper body 14 combined with the upper portion of the joining portion 12 defines a cradle 15 for engaging and positioning another bar parallel to and above the second bar 11. The clip 04 can position a bar parallel to the second bar 11 in the cradle 15, or it can position a first bar 09 in the seat 08, but not both at the same time because the seat 08 and the cradle 15 receive bars in areas which interfere with each other.

Each clip 04 in the clip string 02 is connected to at least one adjoining clip 04 at the connection point 16, as seen in FIG. 1. The connection point 16 can be defined anywhere on the portion of a clip that abuts an adjoining clip 04, as long as the clips 04 are connected together. Each clip 04 has at least one connection point 16, but multiple connection points 16 can be utilized if necessary. The clips 04 are connected such that every clip 04 in the clip string 02 has a consistent orientation. Preferably, the orientation is such that if a bar were received in the hooks 10 of the terminal clip 06, the same bar could be simultaneously received in the hooks 10 of every other clip 04 in the clip string 02. Therefore, there would be one axis defined by the hooks 10 of all of the clips 04 in a clip string 02. Similarly, the cradles 15 defined by the upper bodies 14 of the clips 04 would also be aligned on a single axis.

Figure 3:
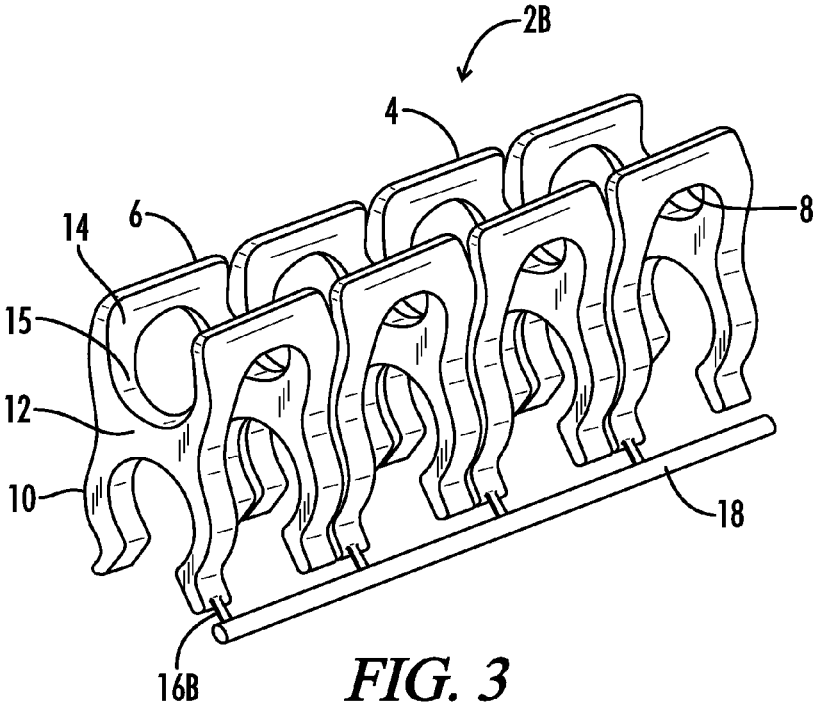
FIG. 3 is a perspective view of the clip string when the feed rod is utilized.
Figure 4:
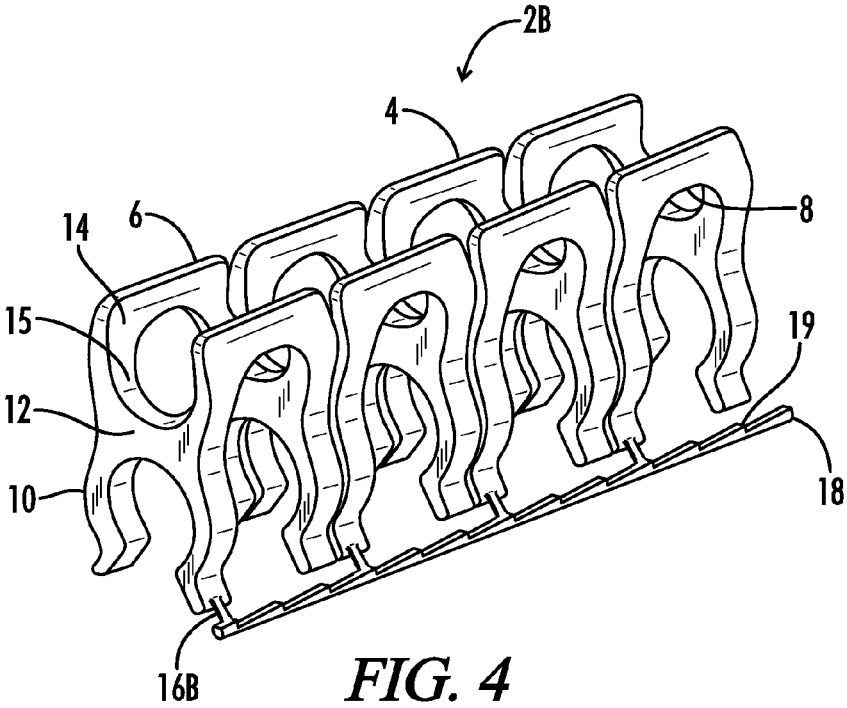
FIG. 4 is a perspective view of the clip string with teeth on the feed rod.

In an alternative embodiment, the clips 04 as defined above are connected to a feed rod 18, as depicted in FIG. 3. If the feed rod 18 is utilized, the connection point 16B connects each clip 04 to the feed rod 18. The feed rod 18 can be positioned anywhere along the side of the clip string 02B as long as the clips 04 are held in a consistent orientation as described above. It is possible for the feed rod 18 to have teeth 19 for advancing the clip string 02B, as shown in FIG. 4. Also, if the feed rod 18 is utilized, each individual clip 04 does not necessarily touch or directly contact the neighboring clip 04. The clips 04 are connected to the feed rod 18, and not to each other, so the clips 04 are not held in direct contact with other clips 04 in the clip string 02B.

Every clip string 02B has only one sized clip 04, but every clip string 02B does not necessarily have the same sized clip 04. The clips 04 are sized to connect a certain size of reinforcing bar, and because there are several sizes of reinforcing bars, there are several sizes of clips 04. Although the size of a clip 04 in different clip strings 02B would vary, the feed rod 18 allows the spacing between neighboring clips 04 to be constant. That is, the distance from the front of a larger clip 04 to the front of a neighboring larger clip 04 in one clip string 02B would be the same as the distance from the front of a smaller clip 04 to the front of a neighboring smaller clip 04 in another clip string 02B. When a feed rod 18 is utilized, this consistent spacing is possible because the clips 04 do not have to touch to be connected together. The consistent spacing is desirable because it allows for a bar connecting apparatus to apply clips 04 of different sizes without having to adjust or change the clip feed mechanism.

Bar Connecting Apparatus

Figure 5:
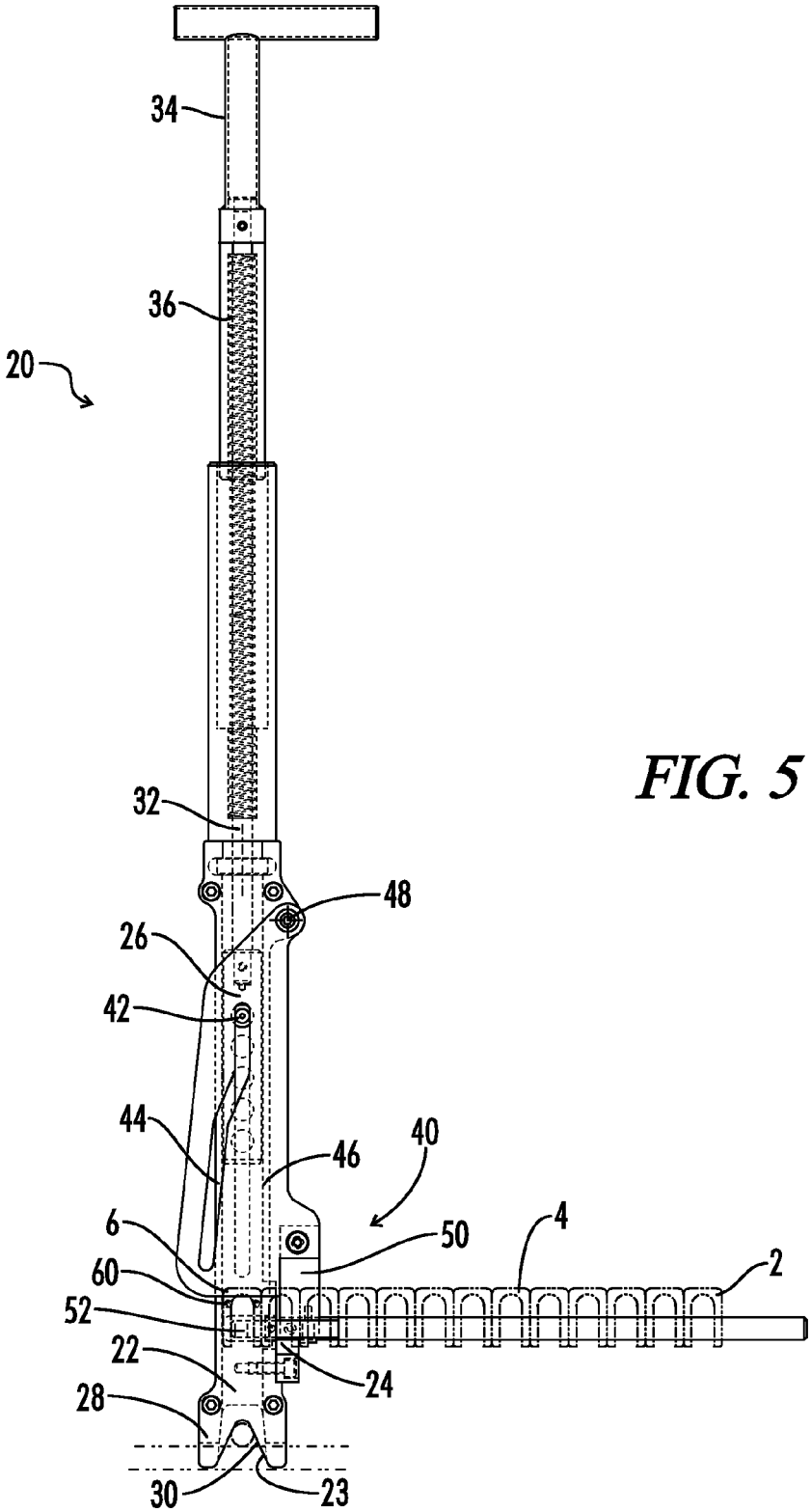
FIG. 5 is a side view of the manually driven embodiment of the bar connecting apparatus.
Figure 6:
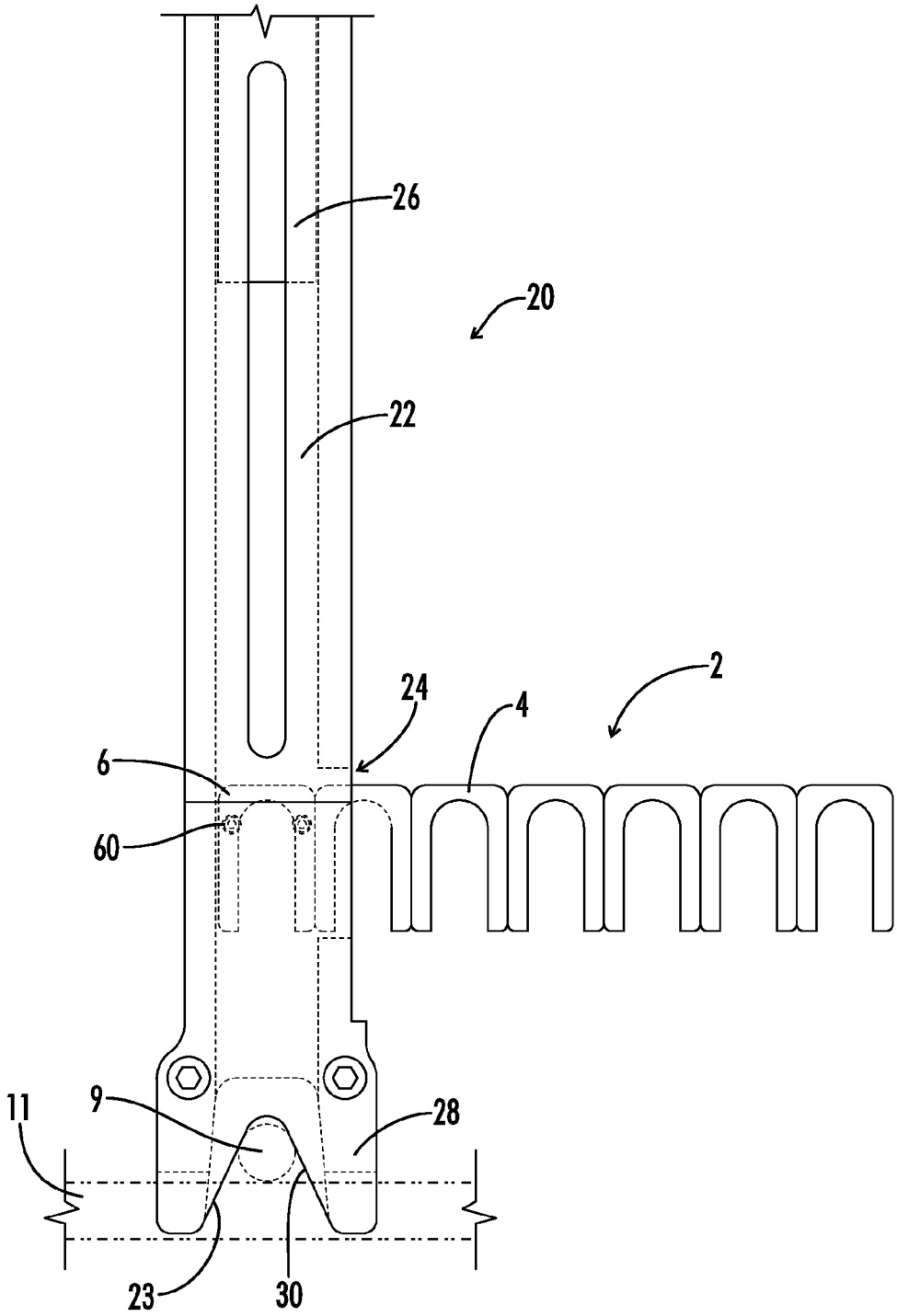
FIG. 6 is a side view of a distal portion of the bar connecting apparatus without the clip feed assembly.

The clip string 02 is utilized in the bar connecting apparatus 20 as shown in FIG. 5. Inside the bar connecting apparatus 20 is a barrel 22 with a clip receiving cavity 24. The terminal clip 06 of the clip string 02 is received into the clip receiving cavity 24 of the barrel 22, which can be seen more clearly in FIG. 6. FIG. 6 does not include the clip feeding mechanism, to more clearly show the barrel 22 with the clip receiving cavity 24. The clip receiving cavity 24 includes a hole in the side of the barrel 22 which is adapted to receive clips 04 from the clip string 02. Inside the barrel 22 is a hammer 26 which reciprocates longitudinally within the barrel 22. As the hammer 26 reciprocates distally, it contacts the terminal clip 06 and expels the terminal clip 06 out the distal end of the barrel 23.

There is an alignment head 28 defined at the distal end of the barrel 23, which aligns the clip applying apparatus 20 with the bars to be connected. When the terminal clip 06 is ejected from the barrel 22, the alignment head 28 ensures the bar connecting apparatus 20 is properly aligned with the bars such that the terminal clip 06 connects the bars. After the terminal clip 06 is ejected the hammer 26 reciprocates proximally, the next clip 04 in the clip string 02 is advanced into the clip receiving cavity 24 and becomes the new terminal clip 06, and the clip applying process is ready to be repeated.

Figure 7:
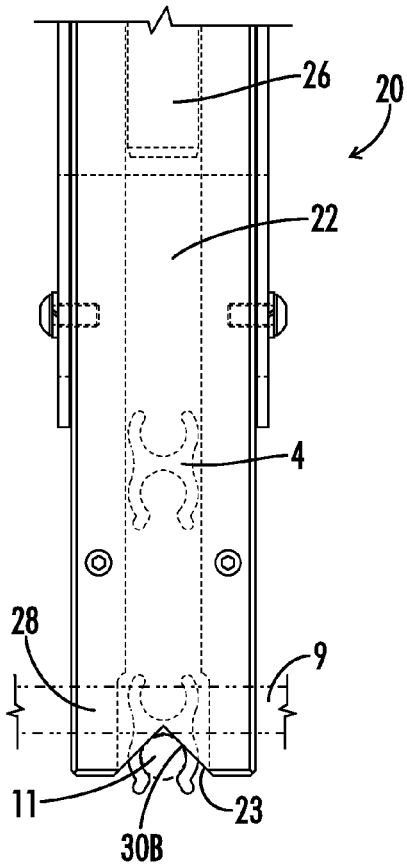
FIG. 7 is a front view of a distal portion of the bar connecting apparatus without the clip feed assembly.

The alignment head 28 has two pair of notches 30, 30B adapted to engage transverse bars, as seen in FIGS. 6 and 7. For the sake of clarity, FIG. 7 also does not show the clip feeding mechanism. One pair of notches 30 is deeper than the other pair 30B, so the first bar 09, which is on top, is engaged in the deeper pair of notches 30 and the second bar 11, which is underneath the first bar 09, is engaged in the more shallow pair of notches 30B. The notches 30, 30B in each pair are on opposite sides of the alignment head 28, so the four points of contact between the notches 30, 30B and the transverse bars 09, 11 prevent the bar connecting apparatus 20 from moving. The alignment head 28, when engaged with the transverse bars, fixes the position of the bar connecting apparatus 20 in three dimensions.

Figure 8:
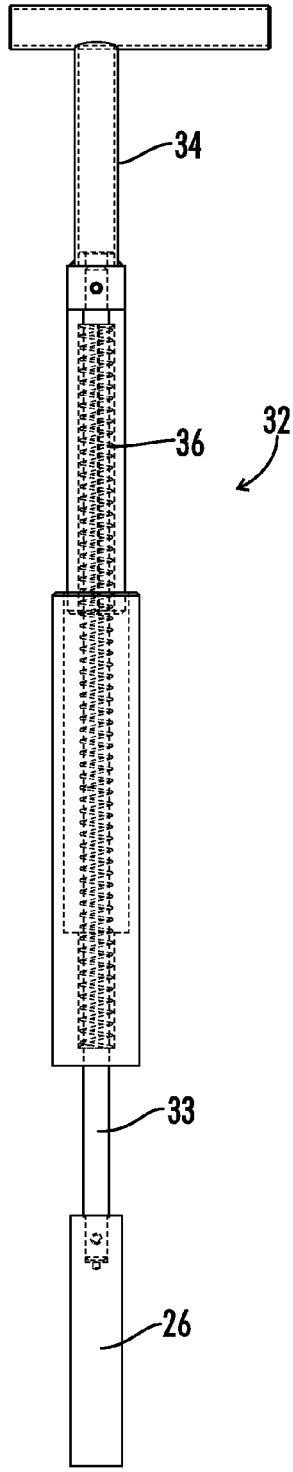
FIG. 8 is a side view of the manual drive portion of the bar connecting apparatus with an attached hammer.

The hammer 26 is reciprocated by a drive 32, as seen in FIGS. 5 and 8. FIG. 8 depicts the hammer 26 and the manual drive 32, without the remainder of the bar connecting apparatus 20. The drive 32 includes a drive rod 33 which is actuated either manual or automatically. The act of connecting the drive rod 33 to the hammer 26 can be aided by wrench flats in the drive rod 33. In the manual embodiment, the drive 32 includes a handle 34 and a biasing spring 36. The handle 34 is manually depressed to extend the hammer 26 distally for ejecting the terminal clip 06 from the barrel 22. The biasing spring 36 then biases the handle 34 proximally and retracts the hammer 26 to a position such that the next terminal clip 06 can be introduced into the clip receiving cavity 24.

Figure 9:
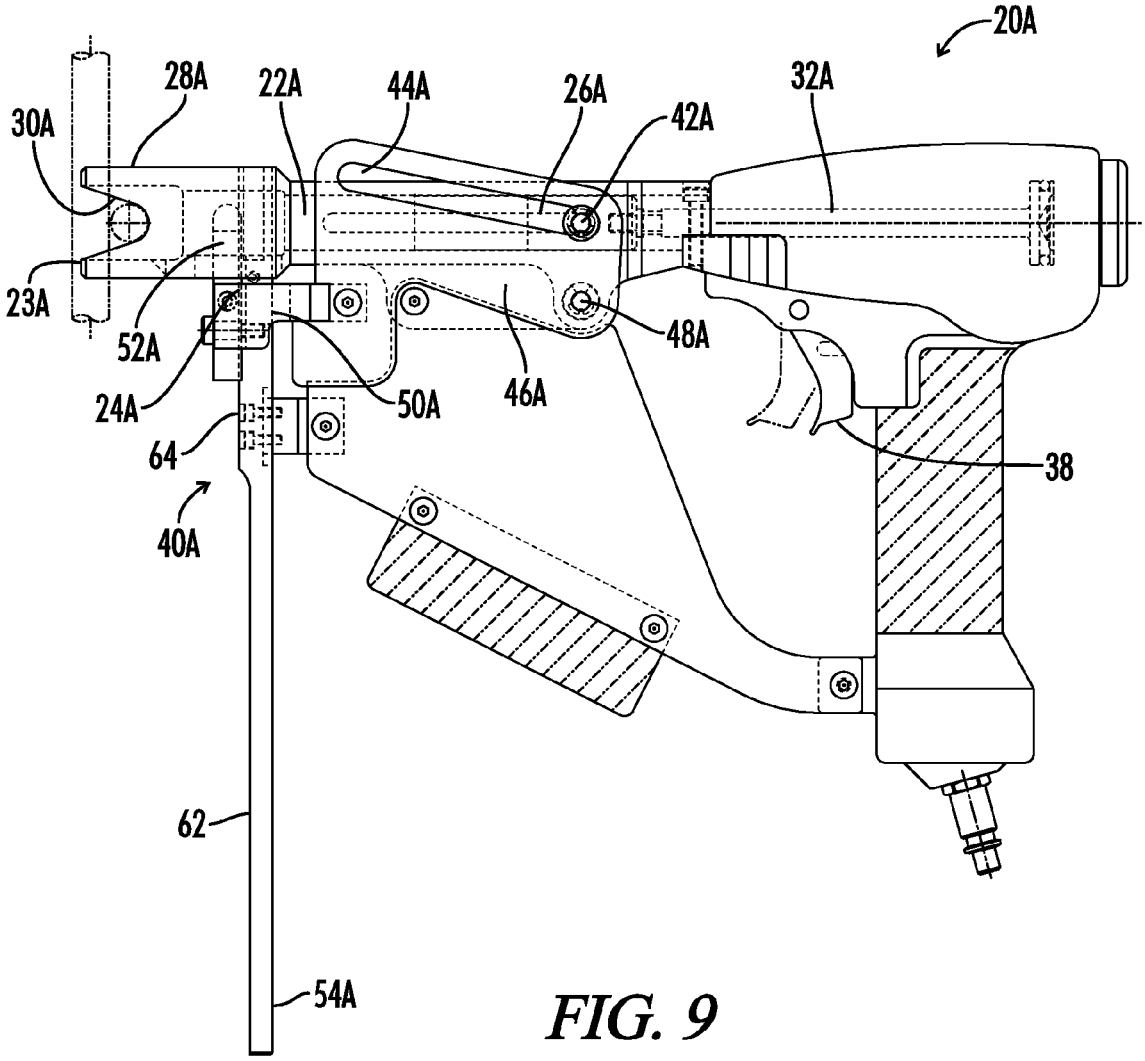
FIG. 9 is a side view of the pneumatically driven embodiment of the bar connecting apparatus.

FIG. 9 depicts the bar connecting apparatus 20A with a trigger actuated automatic drive 32A. For the sake of clarity, similar components in the manual and automatic embodiments are given the same name and number, but the component numbers in the automatic embodiment are designated with an "A." The drive 32A includes a trigger 38 for directing a power source to cycle the drive 32A, such that the power source biases the drive 32A distally when the trigger 38 is depressed and proximally when the trigger 38 is released. In the preferred embodiment, the power source is pneumatic; however, other power sources, such as an electric power source, could also be utilized. Additionally, an extension can be added to either the automatic or manual drive 32, 32A so an operator can stand upright while connecting bars.

Clip Feed Assembly

Figure 10:
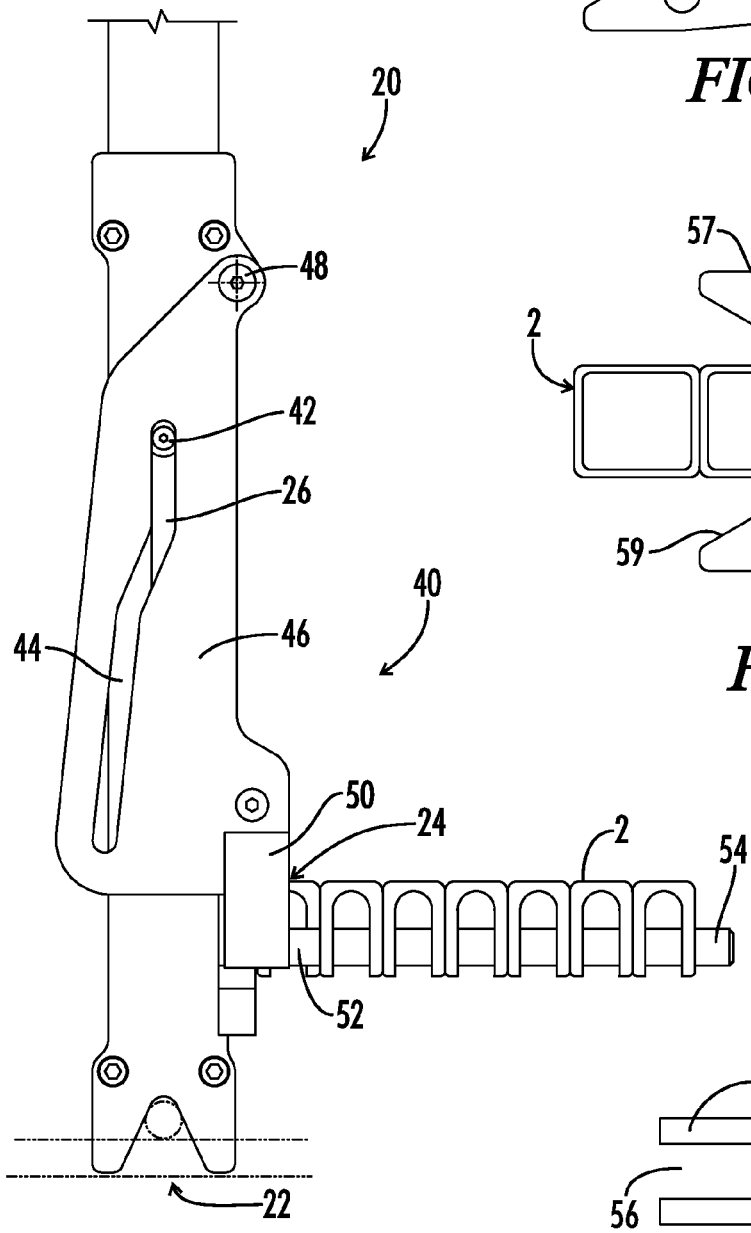
FIG. 10 is a side view of a distal portion of the bar connecting apparatus.

The clip feed assembly 40 advances the clip string 02 into the clip receiving cavity 24 as the hammer 26 reciprocates, as seen in FIG. 10. A cam guide 42 is connected to the side of the hammer 26. The cam guide 42 passes through a straight slot and protrudes from the side of the barrel 22. Therefore, the cam guide 42 reciprocates outside of the barrel 22 as the hammer 26 reciprocates inside of the barrel 22. The cam guide 42 can include a bearing to make the motion of the cam guide 42 smoother.

The portion of the cam guide 42 which protrudes from the side of the barrel 22 is engaged in a slot type cam track 44. The cam track 44 is defined in the cam plate 46, and the cam plate 46 is pivotally connected to the bar connecting apparatus 20 at a pivot point 48. The cam track 44 has an angled section such that as the hammer 26 and cam guide 42 cycle, the cam plate 46 pivots at the pivot point 48 and reciprocates laterally. The cam track 44 can also include straight sections, which are used for timing purposes to coordinate the clip feed assembly operation 40 with the cycling of the hammer 26. The cam plate 46 reciprocates away from the barrel 22 as the hammer 26 reciprocates distally, and the cam plate 46 reciprocates towards the barrel 22 as the hammer 26 reciprocates proximally. With the slot type cam track 44 no return spring is needed for cam plate 46.

Figure 15:
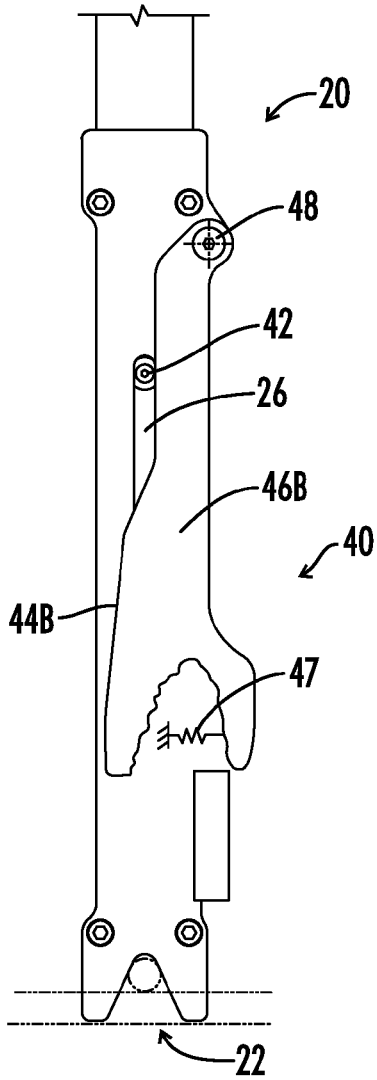
FIG. 15 is a side view illustrating an alternate design for the cam plate.

An alternate design for the cam plate, designated as 46B is shown in FIG. 15. Surrounding parts of apparatus 20 are not shown in FIG. 15 so as to aid in the ease of illustration of cam plate 46B. The cam plate 46B has an edge type cam track 44B instead of the slot 44 of FIG. 10. The edge type cam track 44B is maintained in contact with the reciprocating cam guide 42 by a tension spring 47, which is schematically illustrated in FIG. 15. Any type of resilient return spring could be utilized in place of spring 47 to urge the cam track 44B against cam guide 42. With either the cam plate 46 of FIG. 10 or the cam plate 46B of FIG. 15 the cam plate will reciprocate as the hammer 26 cycles.

Figure 11:
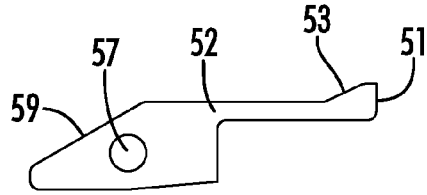
FIG. 11 is a top view of a finger of the clip feed assembly.
Figure 12:
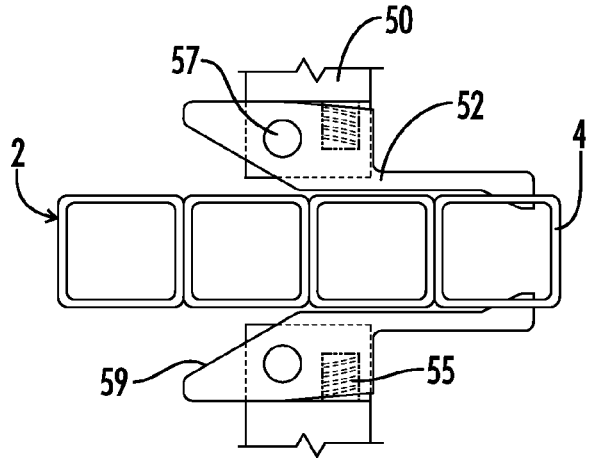
FIG. 12 is a top view of a clip string engaged by fingers of the clip feed assembly.

A feed support block 50 can be positioned at the end of the cam plate 46 to facilitate the feeding of the clip string 02 into the clip receiving cavity 24. At least one finger 52, and preferably two fingers, is connected to the cam plate 46 through the feed support block 50. Referring to FIGS. 10, 11, and 12, the finger 52 has a flat end 51 for engaging the clip string 02 as the cam plate 46 reciprocates towards the barrel 22, but the finger 52 also has a sloped side 53 for sliding past the clip string 02 as the cam plate 46 reciprocates away from the barrel 22.

The finger 52 is pivotally connected to the feed support block 50 at a finger pivot point 57, and a biasing spring 55 urges the finger 52 to engage an individual clip 04 of the clip string 02 as the cam plate 46 reciprocates towards the barrel 22. The finger pivot point 57 allows the finger 52 to ratchet back past the clip string 02 as the cam plate 46 moves away from the barrel 22. Therefore, the clip string 02 sits still as the cam plate 46 reciprocates away from the barrel 22, but the clip string 02 is advanced into the clip receiving cavity 24 as the cam plate 46 reciprocates towards the barrel 22. The clip feed assembly 40 does not utilize a spring or urging device at the back end of the clip string 02 to advance the clips 04 into the clip receiving cavity 24. The above described mechanism engages the hammer 26 with the clip feed assembly 40 so the cycling of the hammer 26 provides the force to urge the clip string 02 into the clip receiving cavity 24.

In the preferred embodiment, the finger 52 has an angled back end 59 which can be pressed to disengage the finger 52 from the clip string 02. When disengaged, the clip string 02 can be withdrawn from the clip receiving cavity 24 without the finger 52 retaining any of the individual clips 04.

Figure 13:
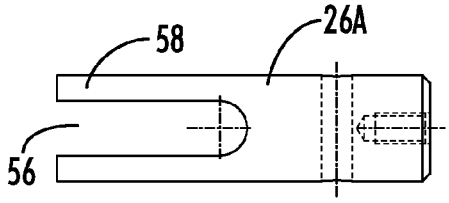
FIG. 13 is a side view of the hammer having an indentation.

The clip string 02 is supported by a clip track 54 when inserted into the bar connecting apparatus 20. The clip track 54 can engage the clip string 02 from either the top or the bottom. Referring now to FIGS. 1, 9, and 13, the clip track 54A can engage the clips 04 by the cradle 15 defined by the upper body 14, or from the top. When the clip string 02 is engaged from the top, the clip track 54A extends through the clip receiving cavity 24A. The clips 04 are then released distally from the clip track 54A. When the clip track 54A extends through the clip receiving cavity 24A, the hammer 26A has an indentation 56 for receiving the clip track 54A as the hammer 26A reciprocates. The hammer 26A has at least one, and preferably two, legs 58 on the side of the indentation 56. The legs 58 contact the upper body 14 of the terminal clip 06 to propel the clip out of the barrel 22A. As the legs 58 propel the terminal clip 06 out of the barrel 22A, the clip track 54A is received in the indentation 56 such that the legs 58 pass beside the clip track 54A.

Figure 14:
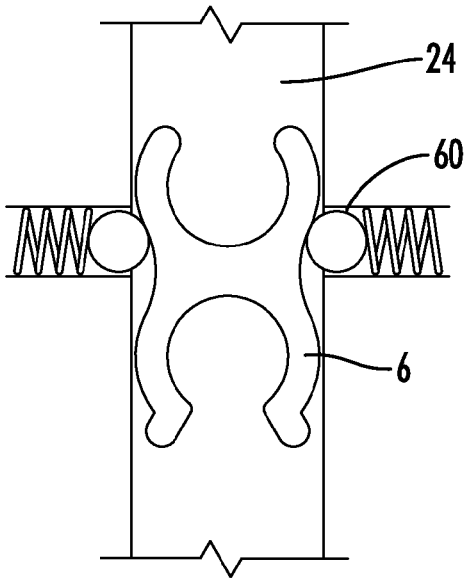
FIG. 14 is a front view of a portion of the clip receiving cavity with resilient retainers.

In the embodiment where the clip track 54 engages the clip string 02 from the bottom, the clip track 54 does not extend through the clip receiving cavity 24, as shown in FIGS. 5 and 10. The clip track 54 terminates at the clip receiving cavity 24 and the hammer 26 can be flat because there is no need to pass around the clip track 54. Referring to FIGS. 5, 10, and 14, because the clip track 54 does not hold the clip 04 in the clip receiving cavity 24, at least one resilient retainer 60 can be used to secure the terminal clip 06 in the clip receiving cavity 24. Preferably, four resilient retainers 60 comprised of ball bearing springs mounted in the clip receiving cavity 24 are used. The resilient retainer 60 releasably engages the terminal clip 06 in the clip receiving cavity 24 to prevent the terminal clip 06 from falling out of the barrel 22 before being expelled by the hammer.

Referring to FIGS. 1 and 9, the clip track 54A is further comprised of at least a first portion 62 and a second portion 64. The second portion 64 is dimensioned to frictionally engage and lightly hold the clip string 02. The first portion of the clip track 62 has smaller dimensions which do not frictionally engage or hold the clip string 02, so the clips 04 will easily slide across the first portion of the clip track 62. This allows the clips 04 to be easily engaged with the first portion of the clip track 62, and yet still be frictionally engaged and held in positioned by a shorter second portion 64. The second portion of the clip track 64 is between the barrel 22A and the first portion 62 so that the clip string 02 is frictionally engaged when in a position to enter into the clip receiving cavity 24A.

Method of Connecting Bars

The current invention also includes a method of connecting bars, which is shown in FIGS. 1, 5, and 10. The method includes providing a bar connecting apparatus 20 for applying clips 04 as described above. A clip string 02 is engaged with the clip track 54 of the bar connecting apparatus 20, and then slid along the clip track 54 until at least one clip 04 is received in the clip receiving cavity 24. The bar connecting apparatus 20 is then aligned with two transverse bars to be connected by an alignment head 28. The alignment head 28 has two pair of notches 30, so when the alignment head 28 is properly positioned each bar is engaged with one pair of the notches 30. The bar connecting apparatus 20 is actuated, which reciprocates a hammer 26 in the barrel 22. The hammer 26 contacts and expels the clip 04 received in the clip receiving cavity 24 such that the clip connects the bars. The cycling of the hammer 26 also cycles the clip feed assembly 40 to advance another clip 04 from the clip string 02 into the clip receiving cavity 24 for a subsequent clip application. The clip string 02 is advanced into the clip receiving cavity 24 in a direction transverse to the direction of reciprocation of the hammer.

Thus, although there have been described particular embodiments of the present invention of a new and useful BAR CONNECTING APPARATUS, it is not intended that such references be construed as limitations upon the scope of this invention except as set forth in the following claims.

What is claimed is:

1. A method of connecting bars comprising:

(a) providing an apparatus for applying clips to connect bars, the apparatus including a barrel having an open distal end;

(b) engaging a clip string with a clip track of the bar connecting apparatus, the clip string including a plurality of connected clips, each clip including a downwardly open lower seat, a downwardly open upper seat oriented transversely to the lower seat, and an upwardly open upper seat oriented parallel to the lower seat;

(c) sliding the clip string along the clip track such that at least one clip is received in a clip receiving cavity of the bar connecting apparatus, with the downwardly open lower seat and the downwardly open upper seat open toward the open distal end of the barrel;

(d) aligning the bar connecting apparatus on two transverse bars; and (e) reciprocating a hammer distally then proximally in the barrel of the bar connecting apparatus such that the distal stroke of the hammer contacts and expels the clip received in the clip receiving cavity to seat the two transverse bars in the downwardly open lower seat and the downwardly open upper seat and thereby connect the bars with the clip.

2. The method of claim 1 wherein step (e) further comprises advancing the clip string into the clip receiving cavity for a subsequent clip application, the clip string advancing in a direction transverse to a direction of reciprocation of the hammer.

3. The method of claim 1 wherein step (d) further comprises positioning an alignment head having two pair of notches on the transverse bars to be connected such that each bar is engaged in one pair of notches.

4. A method of connecting bars comprising:

(a) providing a bar connecting apparatus, the apparatus including a barrel with a clip receiving cavity, the barrel having an open distal end, a hammer received in the barrel, and a clip feed assembly;

(b) inserting a terminal clip of a clip string into the clip receiving cavity, each clip of the clip string including a downwardly open lower seat, a downwardly open upper seat oriented transversely to the lower seat, and an upwardly open upper seat oriented parallel to the lower seat, the terminal clip having its downwardly open lower seat and its downwardly open upper seat open toward the open distal end of the barrel;

(c) aligning the bar connecting apparatus on two transverse bars; and (d) reciprocating the hammer distally then proximally in the barrel of the bar connecting apparatus such that the distal stroke of the hammer contacts and expels the terminal clip to seat the two transverse bars in the downwardly open lower seat and the downwardly open upper seat of the terminal clip and thereby connect the bars with the clip.

5. The method of claim 4 further comprising advancing a new terminal clip into the clip receiving cavity for a subsequent clip application after step (d).

6. The method of claim 4 wherein step (c) further comprises positioning an alignment head having two pair of notches with different depths on the transverse bars to be connected such that each bar is engaged in one pair of notches.

7. An apparatus for connecting bars comprising:

a clip string having a terminal clip, the clip string comprising a plurality of connected clips, wherein each clip has a downwardly open lower seat, a downwardly open upper seat oriented transversely to the lower seat, and an upwardly open upper seat oriented parallel to the lower seat;

a barrel having a clip receiving cavity and an open distal end, the terminal clip being received in the clip receiving cavity with the downwardly open lower seat and the downwardly open upper seat open toward the open distal end of the barrel; and a hammer received in the barrel, the hammer reciprocating longitudinally within the barrel for contacting and expelling the terminal clip from the barrel.

8. The apparatus of claim 7 further comprising an alignment head, wherein the alignment head is defined at the barrel distal end, and wherein the alignment head has notches for engaging transverse bars.

9. The apparatus of claim 7 further comprising a drive, wherein the drive is connected to the hammer for reciprocating the hammer, wherein the drive further comprises a handle and a spring, the spring biasing the handle proximally, and wherein the handle is manually actuated to cycle the drive.

10. The apparatus of claim 7 further comprising a trigger actuated automatic drive, wherein the drive is connected to the hammer for reciprocating the hammer.

11. The apparatus of claim 7, further comprising:

a clip feed assembly connected to the barrel for guiding the clip string into the clip receiving cavity, the clip feed assembly including a clip track, the clip string being slidably received on the clip track.

12. The apparatus of claim 8, wherein the notches of the alignment head comprise a first and second pair of notches wherein the first pair of notches are deeper than the second pair of notches such that a bar engaged in the first pair of notches would be transverse to and above a bar engaged in the second pair of notices.

13. The apparatus of claim 11, further comprising:

a resilient retainer engaging at least one of the clips of the clip string such that the clip string is prevented from moving backwards away from the clip receiving cavity.

* * * * *